United States Patent [19]

Feldman et al.

[11] 4,179,224

[45] Dec. 18, 1979

[54] SELF-CENTERING PRESSURE ROLLER FOR SHEET FEEDING MECHANISM

[75] Inventors: Edward Feldman, Teaneck; Heinz R. Guenther, Cedar Knolls, both of N.J.

[73] Assignee: The Perkin-Elmer Corporation, Norwalk, Conn.

[21] Appl. No.: 892,006

[22] Filed: Mar. 30, 1978

Related U.S. Application Data

[63] Continuation of Ser. No. 754,861, Dec. 27, 1976, abandoned.

[51] Int. Cl.[2] ..... B41J 13/02

[52] U.S. Cl. ..... 400/637

[58] Field of Search ..... 400/636, 636.3, 637, 400/637.1–637.6, 638, 639, 641

[56] References Cited

U.S. PATENT DOCUMENTS 3,421,612 1/1969 Pitt ..... 400/636

FOREIGN PATENT DOCUMENTS 2124877 12/1972 Fed. Rep. of Germany ..... 400/637.2

*Primary Examiner*—Edgar S. Burr
*Assistant Examiner*—A. Heinz
*Attorney, Agent, or Firm*—Salvatore A. Giarratana; Francis L. Masselle; Edwin T. Grimes

[57] ABSTRACT

A self-centering pressure roller for a high speed paper feed mechanism. The assembly includes two rollers each having an undercut central portion disposed for rotation on parallel axles. The roller axles are supported on a bracket movable in four degrees of freedom. The rollers are urged toward a platen to provide pressure on a paper sheet or web disposed between the rollers and the platen. The geometry of the roller assembly and the platen is chosen so that the reaction force caused by roller contact with the paper sheet or web causes the downstream pressure roller to exert more force on the sheet or web than the other roller thereby preventing bunching of paper between the rollers. The pressure roller assembly is self-aligning thereby preventing skew of paper fed through the assembly in either direction. The assembly can be easily manufactured without special alignment and is adaptable to accommodate many different paper widths.

15 Claims, 3 Drawing Figures

SELF-CENTERING PRESSURE ROLLER FOR SHEET FEEDING MECHANISM

This application is a continuation of patent application Ser. No. 754,861, filed Dec. 27, 1976, now abandoned.

BACKGROUND OF THE INVENTION

The disclosed invention relates to a paper feed mechanism or the like for use in high speed printers or typewriters and specifically to pressure rollers for pressing a paper sheet or web against a platen permitting the web to be advanced as the platen is rotated.

In the field of paper printers, typewriters and the other similar machines, a paper feed mechanism is provided to advance a paper sheet or web so as to present fresh paper to a printing mechanism. Once the fresh paper has been printed on, the sheet or web is advanced again to permit further printing on fresh paper during subsequent printing operations.

The paper feed mechanism of a printer or typewriter frequently is in the form of a pressure roller for pressing the sheet or web against a platen which is rotated after each line is printed to advance the sheet or web to present fresh paper to the printing mechanism. The pressure roller typically takes the form of a rubber coated cylindrical body mounted for rotation on an axle. The cylinder is spring biased toward the platen and disposed for rotation about an axis parallel to the axis of rotation of a platen. A paper sheet or web is fed between the roller and the platen and the spring bias on the roller is sufficient to maintain intimate contact between the platen and the paper sheet or web. As the platen is rotated, the sheet or web is advanced.

In some arrangements, each pressure roller has a plurality of freely rotatable cylindrical portions disposed in spaced relation to each other along each axle, with each cylindrical portion being made with a rubber coating suitable for driving contact with a paper sheet or web. Often a plurality of such pressure rollers are spring biased toward the platen of a printing mechanism to conform a paper sheet or web to the surface of the platen and permit the paper sheet or web to advance past a printing position as the platen is rotated.

As is well known to those skilled in the art, such prior art pressure rollers are quite adequate for use in typewriters and printers where the paper feed rate is relatively slow. In such applications, the operator must take care to align the paper carefully as the feed mechanism will feed the paper at the same angle to the platen thereafter. If the paper sheet or web is not correctly aligned, it will gradually shift relative to the platen so the print margin will shift relative to the edge of the sheet or web. But aside from the initial alignment problem which is problematical with most paper feed systems of the type described, such paper feed mechanisms usually cause the sheet or web to become somewhat misaligned as the paper is fed through the printer. This problem is especially acute when long fan fold webs are used as the misalignment introduced by the paper feed mechanism is cumulative as paper is fed through the printer.

In attempting to overcome this problem, alternative feed systems have been used in high speed printers. The most frequently used feed is one using a sprocket wheel for engaging sprocket holes along the longitudinal edges of the paper being printed on. After printing, the sprocket holes along the paper edges can be removed, if desired, on some fan fold paper webs by separating the edges with the sprocket holes therethrough along slit perforations in the web which run parallel to the edge. The sprocket feed for such printers, however, contribute to manufacturing expense due to the cost of sprocketed drive mechanisms and to paper cost due to the requirement of edge perforation. A further problem arises from the fact that the printer must be adjusted when paper of different width is used. The mechanism permitting such adjustment to accomodate different paper width is expensive.

In view of the problems associated with known paper feed mechanisms, it is the primary objective of the present invention to provide a paper feed mechanism suitable for use in a high speed printer which does not cause a paper sheet or web fed therethrough to become misaligned.

It is a further objective of the invention to provide a paper feed mechanism for highspeed printers and the like which is not complex in structure yet is suitable for use with many different paper widths without requiring adjustment.

It is yet another objective of the invention to provide a paper feed mechanism which is operable at high speed in either direction and does not cause paper skew or bunching.

It is still another objective of the invention to provide a paper feed mechanism operable at high speed in either direction and is easily manufactured and does not require careful adjustment.

SUMMARY OF THE INVENTION

In achieving these and other objectives of the invention, a plurality of pressure rollers are mounted in pairs, each pair being mounted in one bracket and each bracket is free to move in four degrees of freedom. Each bracket is supported on a post disposed so its longitudinal axis extends through the center of a platen. The bracket support permits bracket rotation about the post longitudinal axis as well as pivoting relative to the post about an axis perpendicular to the post longitudinal axis. In addition, the bracket is movable around the post longitudinal axis. Each bracket is urged toward the platen by a spring which is coiled around the post and under compression. The pivot point for the bracket is located below the rotation axis of each roller at a point where the reaction forces on the rollers passes below the bracket pivot point. This results in a moment that tends to increase the pressure of the downstream roller in each roller pair so that the paper is pulled past each roller pair. Accordingly, the tendancy of the paper to bunch as it enters the printer is reduced. Additionally, as each roller is mounted in a bracket parallel to another roller and equidistant from the post and the bracket is free to move in 4 degrees of freedom, the rollers will always rotate parallel to the platen axis. As such, no sideways forces are exerted on the paper passing therethrough to cause paper skew.

BRIEF DESCRIPTION OF THE DRAWINGS

The foregoing and other objects, advantages and features of the invention will be described below in greater detail taken in connection with the drawings wherein.

DETAILED DESCRIPTION

Figure 1:
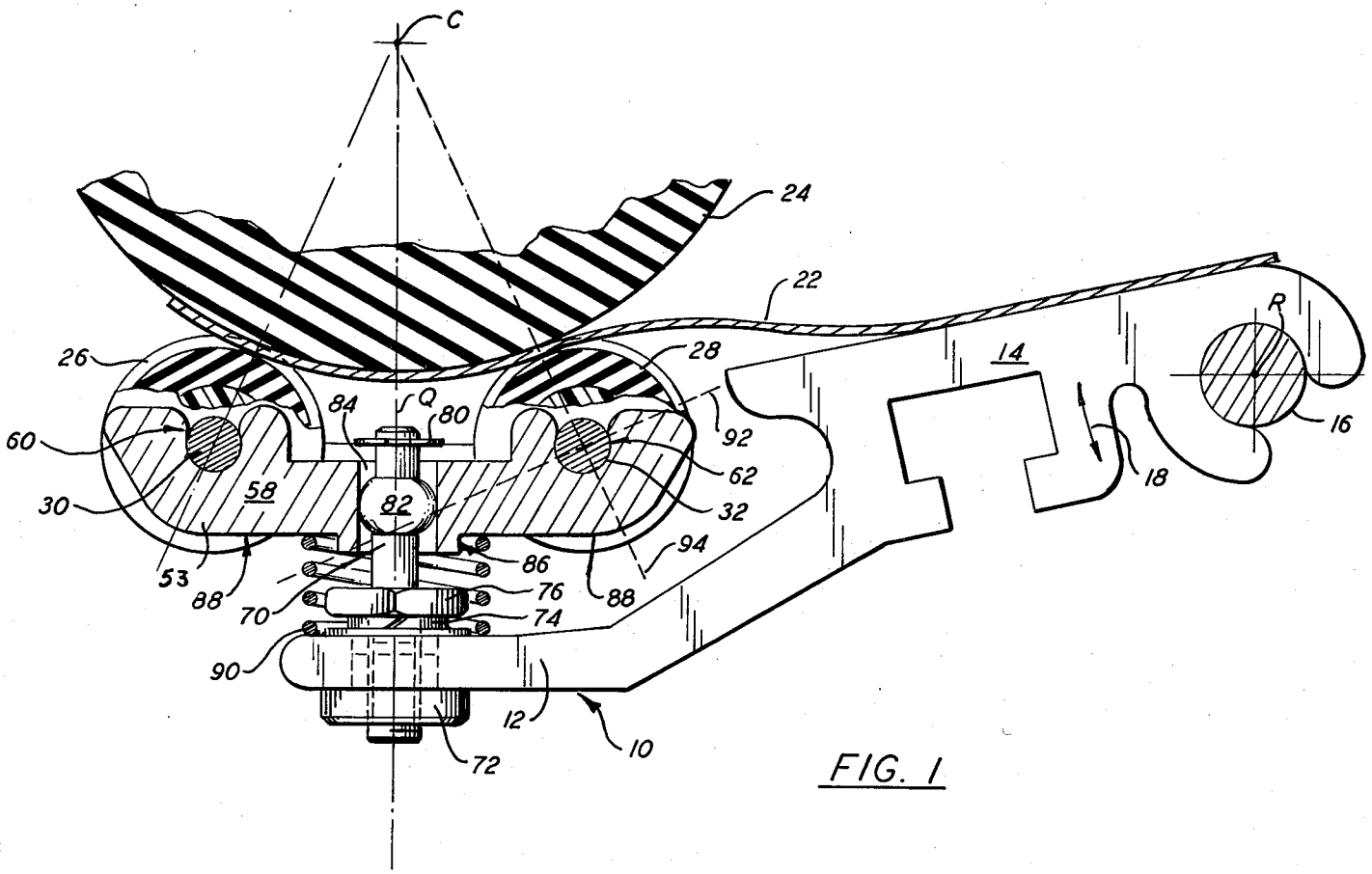
FIG. 1 is a side view partially cut away of the pressure roller assembly of the invention showing its relation to a platen.

Referring first to FIG. 1, the pressure roller assembly according to the present invention is shown generally at 10 and is mounted on the extending arm portion 12 of a support member 14 which is pivotally mounted on a support rod 16 extending the length of the support member 14 in a direction generally perpendicular to the page of FIG. 1. The support member 14 is rotatable both clockwise and counterclockwise about the longitudinal axis R through the support rod 16 as indicated by the double-headed arrow 18. The power for pivoting the support member 14 about the axis R is provided by an external mechanism (not shown) which pivots the support member 14 in a clockwise direction so as to engage the pressure roller assembly 10 with a paper sheet or web 22 thereby holding a paper sheet or web 22 against a platen 24. When the sheet 22 is not held in pressure engagement with the surface of the platen 24, the external mechanism pivots the support member 14 in a counter clockwise direction. Accordingly, when the support member is disposed in its paper feeding position as shown in FIG. 1, the sheet or web 22 is firmly held between the platen 24 and two pressure rollers 26 and 28 which are urged toward the platen by the mechanism forcing the support member 14 in a clockwise direction. As such, whenever the platen 24 is rotated either in a clockwise or a counter clockwise direction, the sheet or web 22 advances in a direction corresponding to the direction of rotation of the platen 24. On the other hand, when the external mechanism permits the support member 14 to pivot counterclockwise about the support rod 16, the sheet or web 22 becomes disengaged from the surface of the platen 24 thereby permitting the paper to be withdrawn from between the pressure rollers 26, 28 and platen 24 without requiring the platen 24 to rotate. Likewise, the platen 24 can rotate without causing a corresponding advance of the sheet or web 22 in the direction of rotation.

The platen 24 is preferably of type used in typewriters and the like and comprises a cylindrical body having a somewhat flexible rubber coated surface and is mounted in a conventional manner for rotation about its longitudinal axis C which is disposed perpendicular to the page of FIG. 1. Preferrably, the platen has a length sufficient to accomodate the widest paper sheet or web 22 on which printing is desired. Such printing is produced by a conventional printing mechanism (not shown) of the type found in typewriters or the like and is disposed adjacent to the surface of the platen 24 at a point removed from the assembly 10. As will become clearer later, a plurality of pressure roller assemblies 10 are disposed along the length of the extending arm portion 12 of the support member 14 in a direction perpendicular to the page of FIG. 1 so as to provide a plurality of pressure points to urge the sheet or web 22 towards the surface of platen 24 along its length. As will be described later in greater detail, each pressure roller is free to become aligned parallel to the axis C of the platen 24 thereby eliminating any sideways directed force on the sheet or web 22 tending to cause it to become misaligned with the platen 24.

In this connection, disposed upstream (to the right of the support member 14) of the platen 24 is a conventional paper alignment mechanism (not shown). This alignment mechanism assures that the paper sheet or web 22 is aligned so that its longitudinal center line is disposed perpendicular to the line of contact between pressure roller 28 and the platen 24 as the paper sheet or web 22 moves into the paper feed mechanism of the invention.

Figure 2:
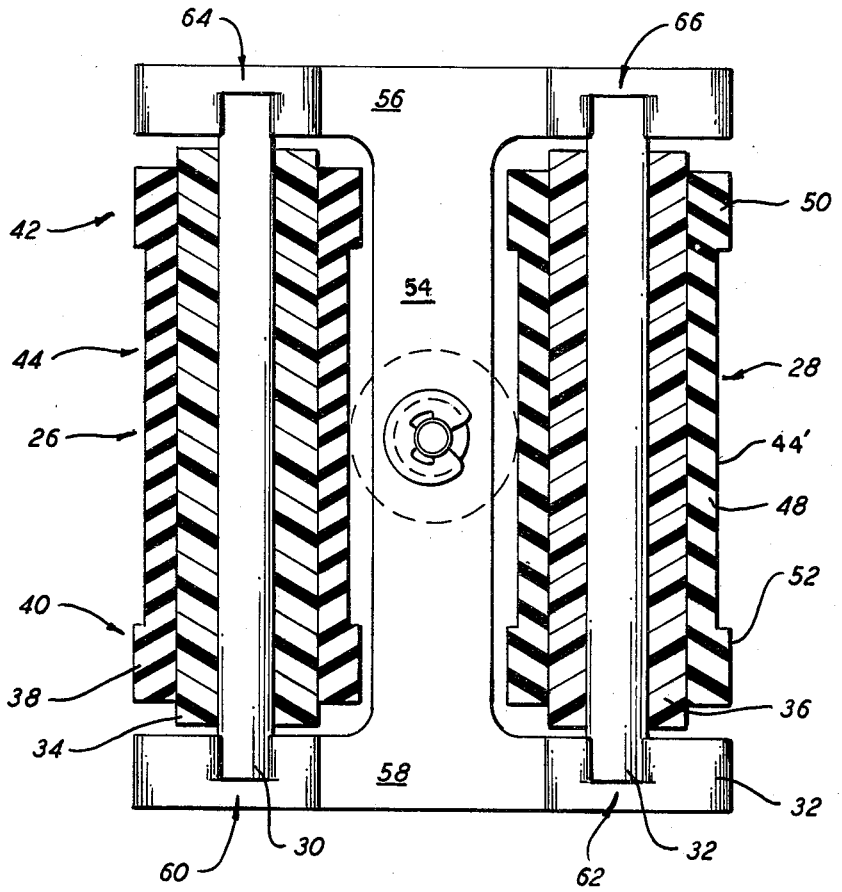
FIG. 2 is a plan view of the pressure roller assembly according to the invention.

Each pressure roller assembly is substantially identical to the assembly 10 shown in FIG. 1 and includes two pressure rollers 26 and 28 each respectively mounted for rotation on an axle 30 and 32. The axles 30 and 32 are preferrably made of a cylindrical metal rod having a smooth exterior surface over which a tubular body 34 and 36 is positioned. As is best shown in FIG. 2, each tubular body 34 and 36 has a smooth central bore which is slightly larger than the outer dimensions of the axles 30 and 32 permitting the tubular body 34 and 36 to be freely rotatable about the rods 30 and 32.

Each tubular body 34 and 36 is preferrably made of a light wieght plastic material although most any other rigid material capable of presenting a smooth inner bore for contact with the other surface of either axle 30 or 32 may be used as well.

Disposed around the outer surface of the tubular body 34 is a sleeve 38 which is preferrably made of a hard rubber or other similar material generally of the type used on the surface of the platen 24. The nature of the material is not critical, however, it is important that sufficient frictional contact between the paper sheet or web 22 and both pressure rollers 26 and 28 is achieved so that the rollers 26 and 28 will not slide but will be in driving contact with the surface of the sheet or web 22 as it is fed through the paper feed mechanism of the invention.

The sleeve 38 has two raised portions indicated at 40 and 42 disposed at opposite ends thereof. Between the raised portions 40 and 42 is an undercut portion indicated at 44 having a smaller diameter than the end portions 40 and 42. The raised portions 40 and 42 are the only portions of the sleeve 38 which actually contact the sheet or web 22 as it passes through the rip between the roller 26 and the platen 24.

The pressure roller 28 also has an exterior sleeve 48 having raised end portions 50 and 52 as well as an undercut portion 44' between them. The undercut portion 44' has a smaller diameter than that for the end portions 50 and 52 so it cannot contact a sheet or web 22 as it passes through the nip between the pressure roller 28 and the platen 24.

The pressure rollers 26 and 28 according to the invention are supported by a bracket support member 53 which is shown best in FIG. 2 and has a central region 54 disposed below the rollers 26 and 28 and symetrically with respect to the two rollers 26 and 28. Two end regions 56 and 58 are disposed generally perpendicular to the central region 54 and the regions 54, 56 and 58 preferrably form a continuous body having a shape, as viewed in FIG. 2, substantially like an H. The two rollers 26 and 28 are each disposed between the end regions 56 and 58. As viewed in FIG. 2, the bracket support member 53 in region 58 has two upwardly facing slots 60 and 62 for respectively receiving the end of axles 30 and 32 therein. These slots 60 and 62 are shaped to receive and retain the axles 30 and 32 after the axles 30 and 32 have been forced downwardly into the slot 60 and 62.

In a similar fashion, the end region 56 of the bracket support member 53 has two upwardly facing slots 64 and 66 also for receiving and retaining respectively the axles 30 and 32. As will become clearer later, the position of the upward facing slots 60, 62, 64 and 66 is selected so that the axles 30 and 32 are located with their longitudinal axis disposed parallel to each other and at an equal distance from the vertically disposed axis Q which extends through a vertically orientated support stud indicated generally at 70 in FIG. 1 and FIG. 3.

The stud 70 is mounted on the extending arm portion 12 of the support member 14 and has threads on its lowermost end for engaging a threaded nut 72 disposed below the arm portion 12. Located above the arm portion 12 is a washer 74 which encircles the stud 70 and a hexagonal section 76 of the stud 70. By tightening the nut 72, the stud 70 is secured to the extending arm portion 12 of the support member 14.

Preferrably, the longitudinal axis Q through the stud 70 is located by selecting the length of the support member 14 and by selecting the location of axis R so that the axis Q extends through the axis of rotation C for the platen 24.

As viewed in FIG. 1, a C ring 80 partially encircling stud 70 engages a slot near the uppermost end of the stud 70 so as to be secured thereto. Disposed between the C ring 80 and the nut 76 is a spherical portion 82 whose smooth outer surface is in contact with the smooth wall of a cylindrical bore 84 which extends through the central region 54 of the bracket support member 53. As viewed both in FIG. 1 and FIG. 3, the cylindrical bore 84 passes through the central portion 54 of the bracket support member 53 and passes through a downward projecting portion 86 which extends below the bottom edge 88 of the bracket support member 53. This downward projecting portion 86 has a substantially cylindrical exterior surface whose circumference is sufficiently small that it is completely encircled by the turns of a compression spring 90 which presses upwardly against the bottom edge 88 of the bracket support member 53 and downwardly against the upper surface of the extending arm portion 12 of support member 14. Since the spring 90 is in compression, it forces the bracket support member 53 in an upward direction toward the C ring 80. Accordingly, when the pressure rollers 26 and 28 are pressing against a sheet or web 22 and the support member 53 is not touching the C ring 80, the rollers 26 and 28 are in pressure engagement with the sheet or web 22. Should the support member 14 be rotated in a counter clockwise direction about the axis R, however, the pressure rollers 26 and 28 will disengage from the sheet or web 22 and the bracket support member 53 will ride upwardly on the stud 70 toward the C ring 80 which bears against the upper surface of the central portion 54 of the bracket support member 53 thereby preventing its further upward motion. Accordingly, the C ring 80 serves to retain the bracket support member 53 on the stud 70 whenever the rollers 26 and 28 are not in pressure engagement with a sheet or webb 22 or with the platen 24.

By reason of the fact that the bracket support member 53 is mounted on the stud 70 in the manner described above, the bracket support member 53 is free to move in four degrees of freedom. As viewed in FIG. 1, the bracket support member 53 is free to move relative to an axis disposed perpendicularly to the sheet on which FIG. 1 is drawn wherein the axis passes through the spherical portion 82. This provides one degree of freedom. The bracket 53 is also free to rotate about the axis Q passing through the stud 70 and is also free to move up and down relative to the stud 70 although the compression spring 90 always urges the bracket 53 toward the platen 24. The latter two movements provide two additional degrees of freedom. The fourth degree of freedom is provided by freedom of movement by the bracket support member 53 disposed in the plane of the sheet of FIG. 1 passing through the center of the spherical portion 82 and perpendicular to the axis Q.

A further important aspect of the geometry for the pressure roller according to the invention is that the roller dimension, the platen dimension, the dimensions of the bracket support member 53, and the positioning of the spherical portion 82 on stud 70 is all arranged so that when paper is being driven, the reaction forces on the rollers 26 and 28 parallel to the paper path exerted through the longitudinal axis of the axles 30 and 32 pass through the stud 70 below the center of spherical portion 82 as viewed in FIG. 1. In this manner, if the platen 24 is rotating in a clockwise direction, a moment is exerted by the reaction forces so as to increase the pressure of the roller 26 (the downstream roller when paper feeds from right to left is viewed in FIG. 1) bearing against the sheet or web 22 and decrease the pressure of rolelr 28 bearing against the sheet or web 22. Conversely, if the platen 24 rotates in a counter clockwise direction, the moment tends to increase the pressure of roller 28 (the downstream roller when paper feeds from left to right as viewed in FIG. 1) against the sheet or web 22 while decreasing the pressure of the roller 26. This increased pressure of the "downstream roller" operates to assure that the paper or web is being pulled past the two rollers thereby preventing bunching of the paper between the two rollers which frequently occurs in prior art devices where the force exerted by the rollers against the paper does not change as a function of paper feed direction.

A further important aspect of the geometry of the pressure roller assembly according to the invention is the fact that the pressure roller assembly is self aligning. This aspect of the invention is accomplished in part because the pressure rollers 26 and 28 are always aligned parallel to each other as they are parallel mounted on the same bracket. In addition, the bracket support member 53 is supported on the stud in a manner permitting 4 degrees of motional freedom. Accordingly, as the platen is rotated, the pressure rollers are always positioned with their longitudinal axes disposed parallel to the platen axis regardless of paper thickness. In addition, the raised end portions 50 and 52 are oriented symetrically with respect to the pivot point of the bracket 53. Accordingly, the reaction forces on the bracket 53 are distributed evenly around an axis perpendicular to the central region 54 through the cylindrical bore 84 so that the bracket 53 does not tend to rotate about that perpendicular axis. This fact and the fact that the pressure rollers 26 and 28 are parallel to each other assures that no sideways forces are exerted by the pressure rollers 26 and 28 on a paper sheet or web 22 as it passes through the paper feed of the invention preventing it from becoming skewed.

A dotted line 94 may be drawn in the plane of FIG. 1 passing through the rotational axis C of the platen 24 and the rotational axis of pressure roller 28. A second line may also be drawn through the rotational axis C and the rotational axis of pressure roller 26. A further dotted line 92 may be drawn in the plane of FIG. 1 through the rotational axis of roller 28 and perpendicular to the line 94. This line 92 passes through the stud 70 at a point below the center of the spherical portion 82.

A still further line (not shown) can be drawn through the rotational axis of the pressure roller 26 and perpendicular to the line from C through the rotation axis of roller 26. This still further line will pass through the stud 70 at substantially the same location as does the line 92. The dotted line 92 is a line corresponding to the direction of the reaction forces in the plane of FIG. 1 caused by contact between the pressure roller 28 and the sheet or web 22. So long as this line 92 passes below the center of the spherical portion 82, a moment is created about the center of the spherical portion 82 which increases the pressure on the downstream roller (roller 26 when the paper sheet or web 22 travels from right to left in FIG. 1) of the pressure roller pair 26 and 28 regardless of direction of travel of the sheet or web 22 between them and the platen 24. It will be observed that as the thickness of the sheet or webb 22 increases or if a multi-thickness form with carbon paper between sheets or the like passes through the nip between the pressure rollers 26, 28 and the platen 24, the pressure contact between the downstream roller 26 or 28 and the sheet or web 22 increases so long as the intersection of the reaction force line 92 and the axis Q is also displaced further away from the center of the spherical section 82.

Figure 3:
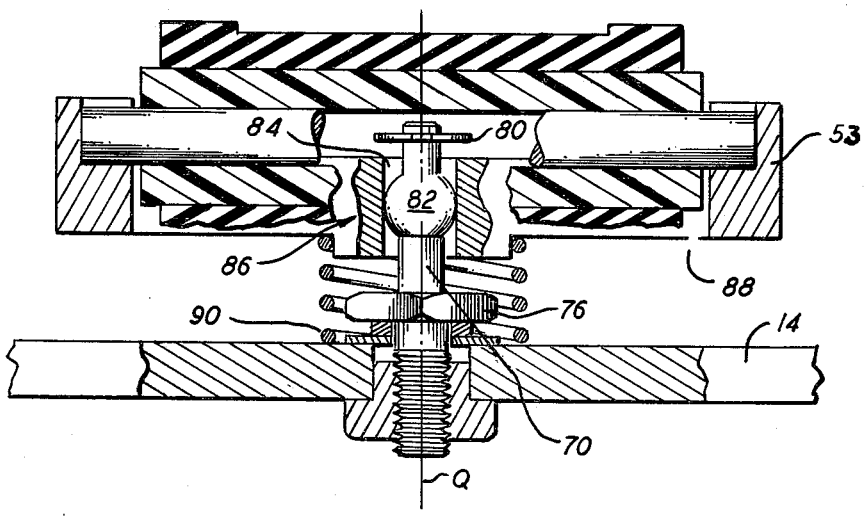
FIG. 3 is a sectional view through one roller and also through the bracket support assembly.

The foregoing description has described a single pair of pressure rollers mounted on a single bracket on the extending arm portion 12 of the support member 14. In the preferred arrangement of the present invention, the pressure rollers 26 and 28 are approximately 2 cm in length, and, accordingly, contact only a small portion of the sheet or webb passing between the pressure rollers and the platen. In order for the paper feed mechanism according to the invention to accomodate many different width sheets or webs, a plurality of pressure roller assemblies such as those shown in FIGS. 1–3 are disposed along the length of the extending arm portion 12 of the support member 14 in a direction perpendicular to the sheet on which FIG. 1 is drawn. Each such pressure roller assembly is free to move in four degrees of freedom and has two rollers with their rotation axes disposed parallel to each other, each at a given distance from the axes through the assembly mounting stud. Further, the rollers have undercut center portions so the roller contact with the sheet or web is only at the ends thereof thereby balancing the forces about the stud axis. Accordingly, there is no force tending to skew the paper passing through the paper feed mechanism of the invention. Further, by providing more pressure by the downstream roller, the sheet or web tends to be pulled through the hip thereby preventing bunching.

The foregoing description has been made with particular emphasis on the pressure roller assembly shown in the drawings. However, those of skill in the art to which the invention pertains, will readily recognize the numerous modifications can be made to the described structure without departing from the spirit and scope of the invention as defined in the following claims.

What is claimed is:

1. A paper web feed apparatus comprising, in combination:

a platen mounted for rotation about a rotation axis;

a pair of pressure rollers each rotatable about a rotation axis;

a roller support bracket for supporting said pressure rollers for paper web against the platen; said rotation axis of each said roller is parallel to said rotation axis of the other said roller;

bracket support means operative to support said bracket in a manner constraining said bracket to linear movement along a line relative to a fixed point in space and permitting rotation of said bracket in three orthogonal degrees of freedom about said fixed point in space independently of the extent of said linear movement; and said platen, said pressure rollers and said bracket are dimensioned so that two unique lines may be drawn in a plane including a line colinear with said linear movement of said bracket in one degree of freedom, each said unique line being drawn perpendicularly through said platen rotation axis and through the rotation axis of one said pressure roller and two further unique lines may be drawn in said plane each perpendicular to one of said two lines and perpendicular to one said pressure roller rotation axis, said two further lines intersecting each other at a second point in space so that said fixed point in space lies between said second point in space and said platen rotation axis.

2. The paper web feed apparatus of claim 1 wherein bracket support means permits movement freedom about three orthogonal axes and translational movement along one of the orthogonal axes.

3. The paper web feed apparatus of claim 1 wherein each said pressure roller has end portions for contacting the web and an undercut portion disposed between the edge portions which cannot contact the paper web.

4. The paper web feed apparatus of claim 1 additionally including means to urge said bracket support means toward said platen.

5. A paper feed mechanism comprising, in combination:

a platen mounted for rotation about a longitudinal rotation axis;

a pair of pressure rollers, each said roller being generally cylindrical in shape with a longitudinal rotation axis, a centrally located undercut portion and an elevated end portion on either side of said centrally located portion;

a roller mounting bracket for supporting said pair of pressure rollers, each said roller being supported for rotation about its longitudinal rotation axis and disposed parallel to the longitudinal rotation axis of the other said roller;

a bracket positioning means permitting linear movement of said bracket in one degree of freedom relative to a fixed point in space and permitting rotation of said bracket in three orthogonal rotational degrees of freedom about said fixed point in space independently of the extent of linear movement;

means to urge said bracket toward said platen to place each said pressure roller into pressure contact with said platen;

said platen, said pressure rollers and said bracket are dimensioned so that two lines may be drawn in a given plane including a line co-linear with said linear movement of said bracket, each said line being drawn perpendicularly through said platen rotation axis and through the rotation axis of one said pressure roller and two further lines may be drawn in said plane each perpendicular to one of said two lines, said two further lines intersecting each other at a second point in space so that said fixed point in space lies between said second point in space and said platen rotation axis; and said bracket positioning means comprising a stud with a longitudinal axis on which said bracket is free to move longitudinally along said stud, to rotate about the longitudinal axis of said stud and to pivot about any axis through and perpendicular to the longitudinal stud axis.

6. The paper web feed mechanism of claim 5 wherein said means to urge comprises a spring in compression.

7. The paper web feed mechanism of claim 5 wherein said means to urge comprises a spring in compression.

8. The web feed mechanism of claim 5 wherein said stud has a spherical portion thereon and said bracket has a cylindrical passage therethrough for encircling said spherical portion, said given point lying at the center of said spherical portion.

9. The paper web feed mechanism of claim 5 wherein said stud is oriented with its longitudinal axis passing therethrough along a line midway between the rotational axes of said pressure rollers.

10. The paper web feed mechanism of claim 9 wherein said rollers are positioned parallel to each other and said stud longitudinal axis passes through said bracket at a point equidistant from the longitudinal rotational axis of said rollers.

11. A paper web feed mechanism comprising, in combination:

a platen substantially cylindrical in shape and mounted for rotation about its longitudinal axis;

a first and a second pressure roller, each said roller being generally cylindrical in shape with a centrally located undercut portion and two elevated end portions disposed on either end of said centrally located portion, each said pressure roller having a longitudinal rotation axis;

a support bracket for supporting said first and said second pressure roller for rotation about the respective longitudinal rotation axis of each said pressure roller with the longitudinal rotation axis of one said roller being parallel to the longitudinal rotation axis of the other roller, said bracket including a cylindrical passage passing therethrough and disposed with the axis of said passage passing through a line midway between the rotation axis of both said pressure rollers and perpendicular to a plane defined by the rotation axes of said pressure rollers;

a support member;

an elongated stud with two ends extending through said cylindrical passage and mounted at one end on said support member and including a releasable retainer means at the other end of said stud to retain said support bracket on said stud while being releasable permitting removal of said support bracket from said stud, said stud including a spherical portion disposed between said support member and said retainer means having dimensions permitting said spherical portion to pass through said cylindrical passage;

means to urge said support bracket towards said retainer means, said stud and said platen being disposed in operation relative to each other so that said pressure rollers contact said platen when said bracket is urged toward said retainer means;

said platen, said pressure rollers and said bracket are dimensioned so that a first line may be drawn intersecting and perpendicular to the rotation axis of each said roller and also perpendicular to one of two other lines drawn perpendicularly from said platen rotation axis to the rotation axis of each said roller, wherein said first line intersects a third line drawn perpendicularly through said platen rotation axis and the center of said spherical portion at a location along said third line such that said center of said spherical portion lies between said location and said platen rotation axis.

12. The paper web feed mechanism of claim 11 additionally including at least one additional stud disposed on said support member, each said additional stud having an additional support bracket with a cylindrical passage therethrough and said additional stud passing through said cylindrical passage through said additional support bracket, said additional stud including a spherical portion which is disposed within said cylindrical passage through said additional support bracket and having a releasable retainer means on said additional stud, means for urging said additional support bracket toward said releasable retainer on said additional stud, said additional support bracket supporting two additional pressure rollers for rotation about parallel axes, said additional bracket, said additional rollers and said platen being dimensioned so that a fourth line may be drawn intersecting and perpendicular to the rotation axis of each said additional roller and also perpendicular to one of a pair of fifth lines drawn perpendicularly from the platen rotation axis to the rotation axis of each said additional roller, said fourth line intersecting a sixth line drawn perpendicularly through said platen rotation axis and the center of said additional spherical portion at an intersection location such that said center of said additional spherical portion lies between said intersection location and said platen rotation axis.

13. The paper web feed mechanism of claim 11 wherein said bracket urging means comprises a coiled spring in compression disposed around said stud between said bracket and said support member.

14. The paper web feed mechanism of claim 11 wherein said bracket has a cylindrical flange portion extending toward said support member symetrically disposed around said stud and fitting into one end of said spring so as to maintain symetrical positioning of said spring with respect to said stud.

15. The paper web feed mechanism of claim 11 wherein said support member is movable relative to said platen between an operational position whereat said pressure rollers can contact said platen and a disengaged position whereat said pressure rollers cannot contact said platen.

* * * * *

UNITED STATES PATENT OFFICE

CERTIFICATE OF CORRECTION

Patent No. 4,179,224 Dated 12/18/79

Inventor(s) Edward Feldman et al.

It is certified that error appears in the above-identified patent and that said Letters Patent are hereby corrected as shown below:

Column 7, line 68, after "rollers for" insert

--pressing a--.

Signed and Sealed this

First Day of July 1980

[SEAL]

Attest:

SIDNEY A. DIAMOND

Attesting Officer

Commissioner of Patents and Trademarks